US006438799B1

(12) United States Patent
Gronbach

(10) Patent No.: US 6,438,799 B1
(45) Date of Patent: Aug. 27, 2002

(54) HINGE

(76) Inventor: Lina Gronbach, Weikertsham 14, 83549 Eiselfing (DE)

( * ) Notice: Subject to any disclaimer, the term of this patent is extended or adjusted under 35 U.S.C. 154(b) by 7 days.

(21) Appl. No.: 09/599,479

(22) Filed: Jun. 23, 2000

(30) Foreign Application Priority Data

Jun. 25, 1999 (DE) ..... 199 29 253
Jul. 12, 1999 (DE) ..... 199 32 443

(51) Int. Cl.[7] ..... E05D 11/10
(52) U.S. Cl. ..... 16/335; 16/249; 16/254
(58) Field of Search ..... 16/335, 82, 86 B, 16/249, 254

(56) References Cited

U.S. PATENT DOCUMENTS 3,712,287 A * 1/1973 Summers ..... 126/191
3,889,654 A * 6/1975 Kauranen et al. ..... 126/194
5,666,764 A * 9/1997 Beatty et al. ..... 49/397
5,896,619 A * 4/1999 Koopman ..... 16/50
5,931,554 A * 8/1999 Koopman ..... 312/405

FOREIGN PATENT DOCUMENTS

DE 8031488.1 3/1981
DE 3143786 6/1982

* cited by examiner

*Primary Examiner*—Anthony Knight
*Assistant Examiner*—Mark Williams
(74) *Attorney, Agent, or Firm*—Dilworth & Barrese, LLP

(57) ABSTRACT

A hinge possesses a casing portion (1) and a lid portion (4) which is movably supported, preferably pivoted (3), on the casing portion (3). So that the hinge can be assembled in a more simple manner, a retaining part (18) is provided on the casing portion (1) or the lid portion (4) by means of which the relative position of both parts (1, 4) is fixed in place (FIG. 1).

29 Claims, 5 Drawing Sheets

HINGE

BACKGROUND OF THE INVENTION

The invention relates to a hinge with a casing portion and a lid portion which is movably supported, preferably pivoted, on the casing portion.

Such hinges are already known. They possess two portions which are movable (for example in the form of a four-bar), preferably rotatable, relative to each other. One of the two portions can be termed the casing portion or hinge casing, the other portion can be termed the lid portion or the movable hinge portion. The casing portion can be connected to a stationary portion of a piece of furniture (that is the furniture body) or of an appliance, for example a freezer. The lid portion can be connected to the movable part of a piece of furniture (for example a cabinet door) or to the movable part of an appliance, for example the lid of a freezer.

During assembly, the hinge is connected to the parts of a piece of furniture or appliance named above. This can be done by means of a screw connection, but also in any other manner.

In a known hinge for a freezer, which is shown in FIG. 8, the casing portion 1 is connected to a freezer 17 by screws 2. The lid portion 4 pivoted at a axis of rotation 3 on the casing portion 1 must be connected to the lid 7 of the freezer by further screws 5, 6.

The hinge comprises a compression spring 8 whose lower end lies on a spring plate 9 which possesses a recess at its centre with which it is supported on a projection 10 of the casing portion 1. The upper end of the compression spring 8 is supported on a collar 11 which is provided on a spring rod 12 which possesses at its upper end a recess 13 with which it connects to an axle 14 provided on the lid portion 4. The axle 14 is located at a distance to the axis of rotation 3. It is moreover movable along a guideway 15 provided in the casing portion 1 which guideway is formed by a cutout 16 and which is located in the side walls of the casing portion 1. The ends of the cutout 16 form stops for the axle 14 whose rotation capability around the axis of rotation 3 is restricted in this way, in the example in FIG. 8 to slightly more than 90°. The assembly is here made in such a way that the hinge is closed over the neutral point by means of the compression spring . The axle 14 in the representation of FIG. 8 is therefore located slightly to the left of, that is outside, the connecting line between the contact point of the central recess of the spring plate 9 on the projection 10 and the axis of rotation 3. In the position shown in FIG. 8, the compression spring 8 presses the axle 14 against the left end of the cutout 16, which forms a stop, so that by means of the action of the compression spring 8 the hinge remains stably in the position shown in FIG. 8.

The hinge is supplied in the stable position shown in FIG. 8. It is then located in the assembly position with biased spring. To ensure that the hinge does not snap open and the discharge of the spring bias lead to dangers, the hinge is closed over the neutral point in the manner described and in the way shown in FIG. 8. However, this has the disadvantage that the lower screw 6, with which the lid portion 4 is to be connected to the lid 7, protrudes in the manner visible from FIG. 8 so that the lower screw 6 is difficult to fit. Furthermore, when the screw connection 6 is tightened, the lid 7 is drawn close. To allow this assembly to be performed, the lid 7 must therefore be movable on the freezer body 17 in order to be able to reach the final position. For the same reason, a vertical movement also occurs so that the lower fastening screws 6 of the lid portion can only be tightened in a second step.

SUMMARY OF THE INVENTION

It is the object of the invention to provide a hinge of the type first described which can be assembled in a more simple manner.

This object is solved in accordance with the invention by providing on the casing portion or on the lid portion a retaining part by means of which the relative position of both portions (that is of the casing portion and the lid portion) are fixed in place. Preferably, the casing portion and the lid portion are fixed in place relative to each other in the assembly position. The casing portion and the lid portion can then be assembled without problem. With the hinge shown in FIG. 8, the disadvantages described above do not occur.

Advantageous further developments are described in the dependent claims.

Preferably, the retaining part is provided on the casing portion. However, it can also be disposed on the lid portion.

In accordance with another advantageous further development, a tension spring is provided on one of the two portions (casing portion or lid portion). Preferably, the spring in question is a compression spring. By means of the tension spring or compression spring a force is exerted on the casing portion and lid portion which moves these two parts relative to each other.

The tension spring or compression spring can be provided on the casing portion of the hinge. However, it is also possible to provide it on the lid portion. Furthermore, a further part can be provided, for example a spring rod or another part by means of which the force exerted by the tension spring or compression spring is exerted on the housing portion and/or the lid portion.

Preferably, the retaining part is made of plastic.

Another advantageous further development is characterised in that the retaining part is inserted in an aperture, preferably in a punched-out opening, in the housing portion or the lid portion. The retaining part is therefore located in this aperture or punched-out opening. Preferably, the retaining part is designed so that it does not protrude. It is advantageous if the retaining part does not protrude on the hinge side, which may be formed by a bent or canted metal plate, so that the packing of the hinges can be performed without hindrance.

Another advantageous further development is characterised in that the aperture or punched-out opening possesses the shape of a polygon. Preferably, the shape of a regular polygon is used. The shape of a square is particularly suitable. The aperture or punched-out opening can, however, also have the shape of an oblong. It is furthermore advantageous if the aperture or punched-out opening possesses a shape which represents security against twisting.

Preferably, the retaining part possesses a serration. In that hinge portion in which the retaining part is not located, a corresponding counter-serration is preferably provided. If, therefore, the retaining part is provided on the casing portion, the counter-serration is located on the lid portion or on a part of the lid portion. If the retaining part is provided on the lid portion, the serration is located on the casing portion or a part of the casing portion. When the serration engages the counter-serration, the relative position of the casing portion and the lid portion is fixed in place.

The serration consists here of at least one tooth. A tooth can here be understood to mean any part of the retaining part which forms a fixing or twist security or any other movement security by acting together with a corresponding other part forming a counter-serration. For example, the tooth may be a projection and the counter-serration a corresponding recess. The serration can, however, also comprise multiple teeth, with the teeth being able to be formed by projections.

Another advantageous further development is characterised in that the serration is provided on several sides of the retaining part, preferably on all sides of the retaining part. This is particularly advantageous when the retaining part possesses the shape of a polygon, preferably the shape of a regular polygon, preferably the shape of a square. In this case, it is advantageous if the serration is provided on several sides of the polygon, preferably on all sides. If the retaining part is formed as a regular polygon, it can be used repeatedly by a twist.

Preferably, that part of the hinge portions or those parts of the hinge portion which fix the hinge in place are destructible. This part or these parts, for example one or more teeth, can be bent off or broken off. Preferably, the part(s) of the retaining part fixing the hinge in place, preferably its/their tooth or teeth, are sized in such a way that they are destroyed by a manual, for example, a first-time, actuation of the hinge. During the assembly of the hinge, the retaining part fulfils its function of fixing the relative position of the parts of the hinge. Then, the parts of the retaining part effecting the fixing in place which are no longer needed are destroyed by a manual actuation of the hinge.

Preferably, the destructible parts of the retaining part are small. They are preferably so small that they do not hinder the actuation of the hinge after their destruction. If the parts effecting the fixing in place can be broken off, they are preferably so small that they cannot lead to a hindrance of the hinge mechanism.

Another advantageous further development is characterised in that the retaining part can be or is marked and/or written on. The retaining part or the hinge retainer can therefore be used as the carrier of a suitable mark or writing, for example for the purpose of distinguishing different hinge types. It can, for example, be used to distinguish the hinge types by a striking colour.

BRIEF DESCRIPTION OF THE DRAWINGS

One embodiment of the invention is described in detail below by means of the enclosed drawing in which.

DESCRIPTION OF THE PREFERRED EMBODIMENTS

Figure 1:
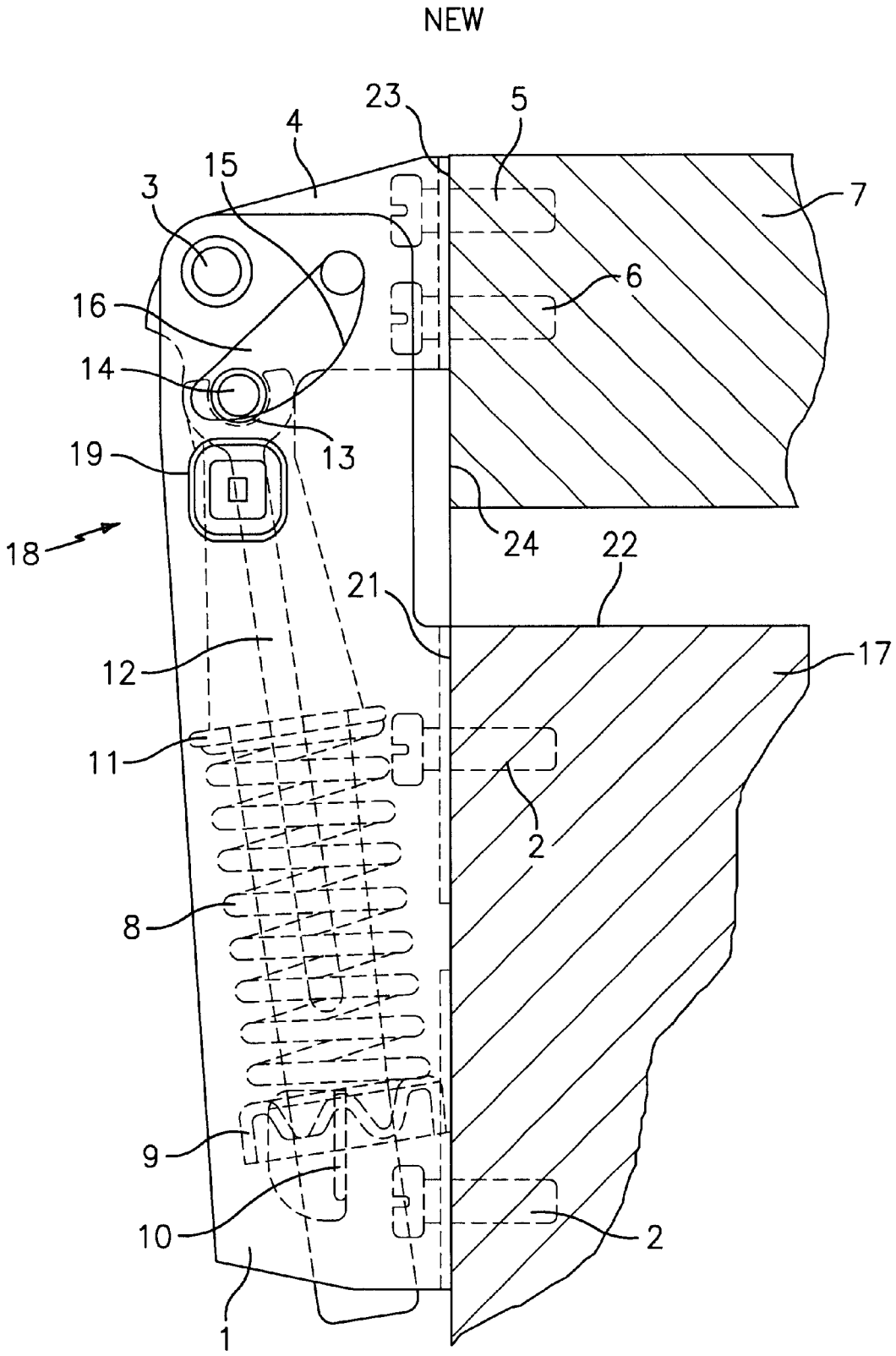
FIG. 1 shows a hinge with a retaining part in the position fixed in place and assembled in a side view from the right.
Figure 2:
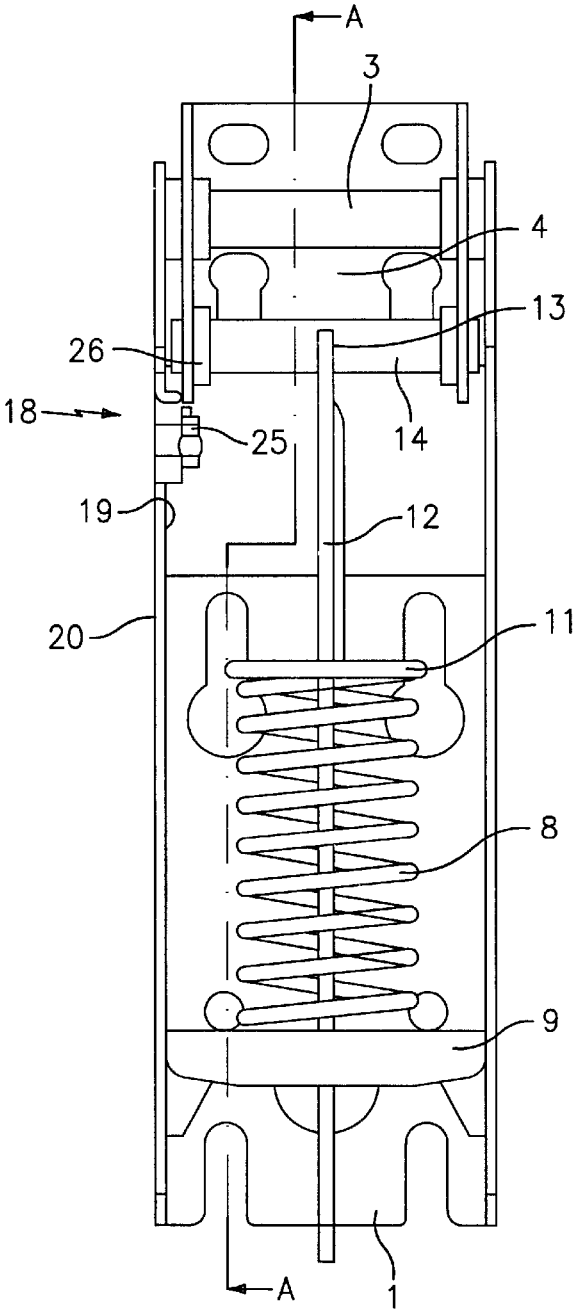
FIG. 2 shows the hinge of FIG. 1 in a view from the rear.
Figure 3:
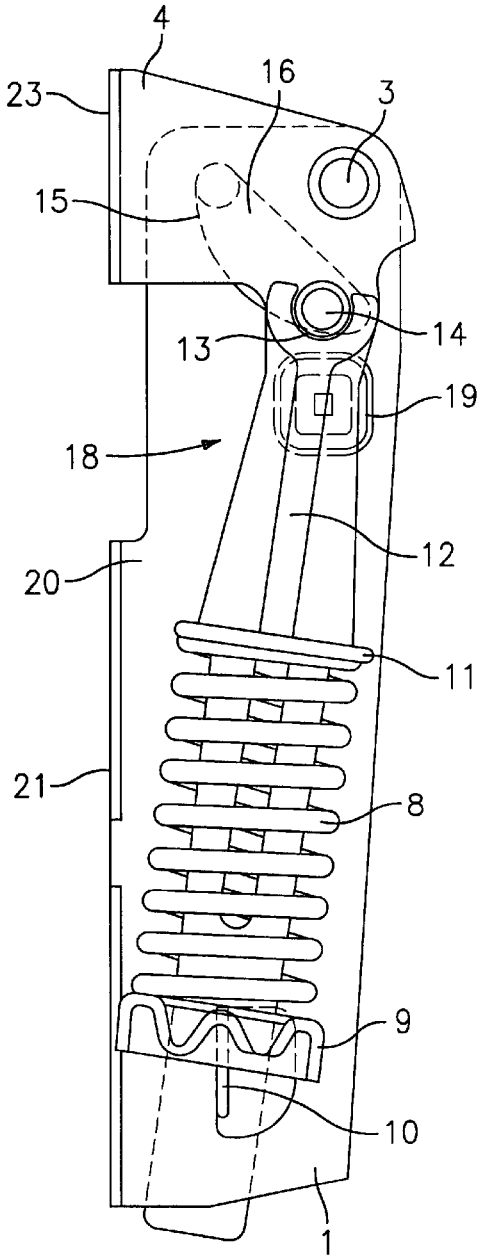
FIG. 3 shows the hinge of FIGS. 1 and 2 in a side view from the left.
Figure 8:
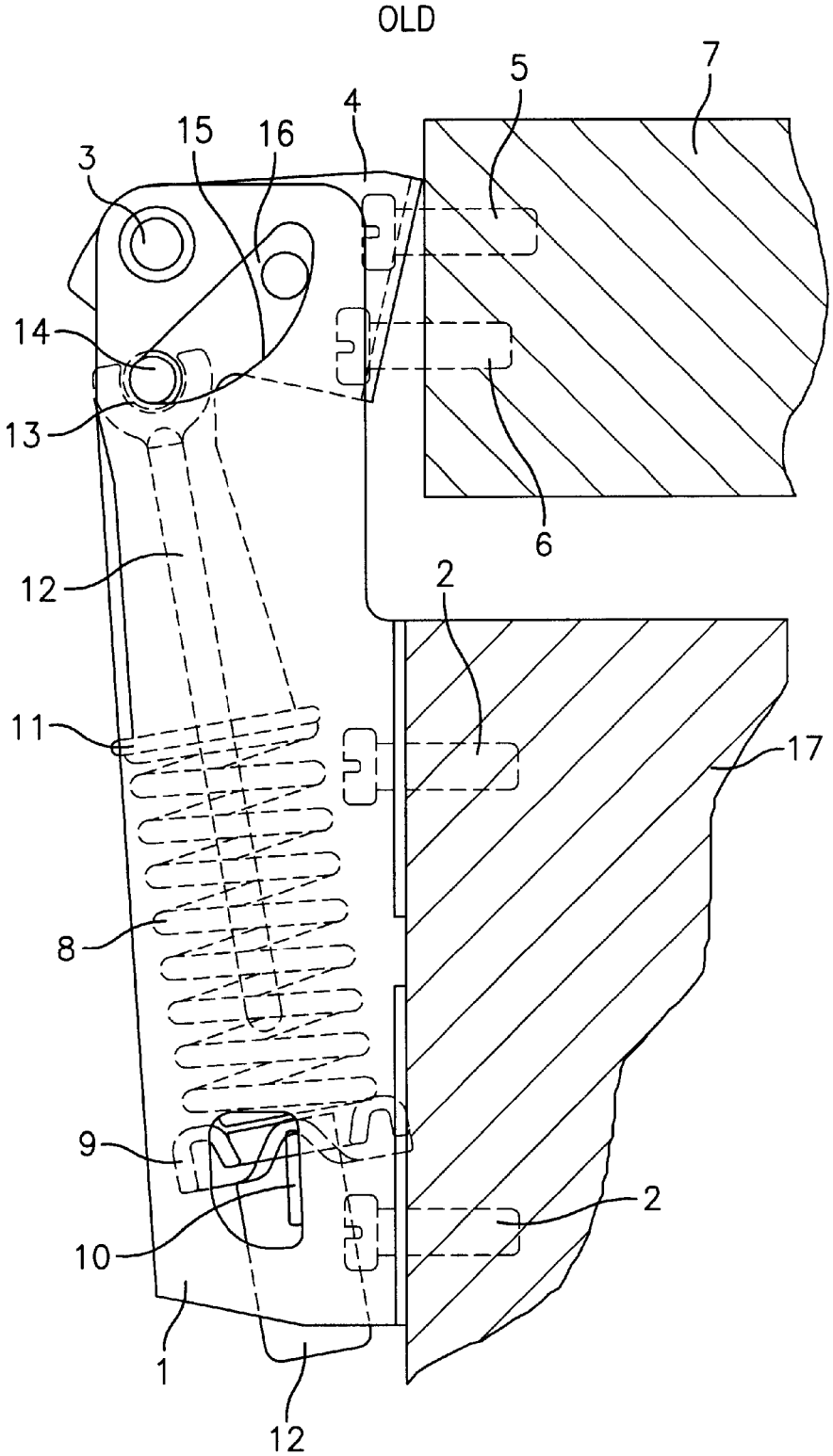
FIG. 8 (PRIOR ART)
FIG. 8 shows a hinge of the prior art without any retaining part in a side view from FIG. 1.

The hinge shown in FIGS. 1 to 3 is essentially designed as that shown in FIG. 8 which has already been described. The reference symbols in FIGS. 1 to 3 correspond to those in FIG. 8 so that the associated parts and their function do not need to be described again.

Unlike the hinge in FIG. 8, the hinge shown in FIGS. 1 to 3 possesses a retaining part 18 which is inserted in a punched-out opening 19 in a side wall 20 of the casing portion 1. The relative position of the casing portion 1 and the lid portion 4 is fixed in place by the retaining part 18. The retaining part 18 possesses the shape of a regular polygon, that is of a square. It is made of plastic. As is visible from FIGS. 1 and 3, the hinge is fixed in place by the retaining part 18 in the assembly position in which the assembly plan 21 of the casing portion 1 agrees with the associated assembly plane 22 of the freezer body 17 and in which the assembly plane 23 of the lid portion 4 agrees with the associated assembly plane 24 of the lid 7. In the example shown in FIGS. 1 and 3, the planes 21, 22 and 23, 24 are congruent with each other. If, however, the relative disposition between the freezer body 17 or the stationary part of a piece of furniture or appliance on the one hand and the lid or movable part of a piece of furniture or appliance on the other is different, the assembly is appropriately selected so that the retaining part fixes the relative position between the casing portion and the lid portion in the then different assembly position so that a tension-free assembly of casing portion and lid portion is possible.

The retaining part 18 possesses a serration 25 which engages a corresponding counter-serration 26 which is provided on the lid portion 4.

Figure 5:
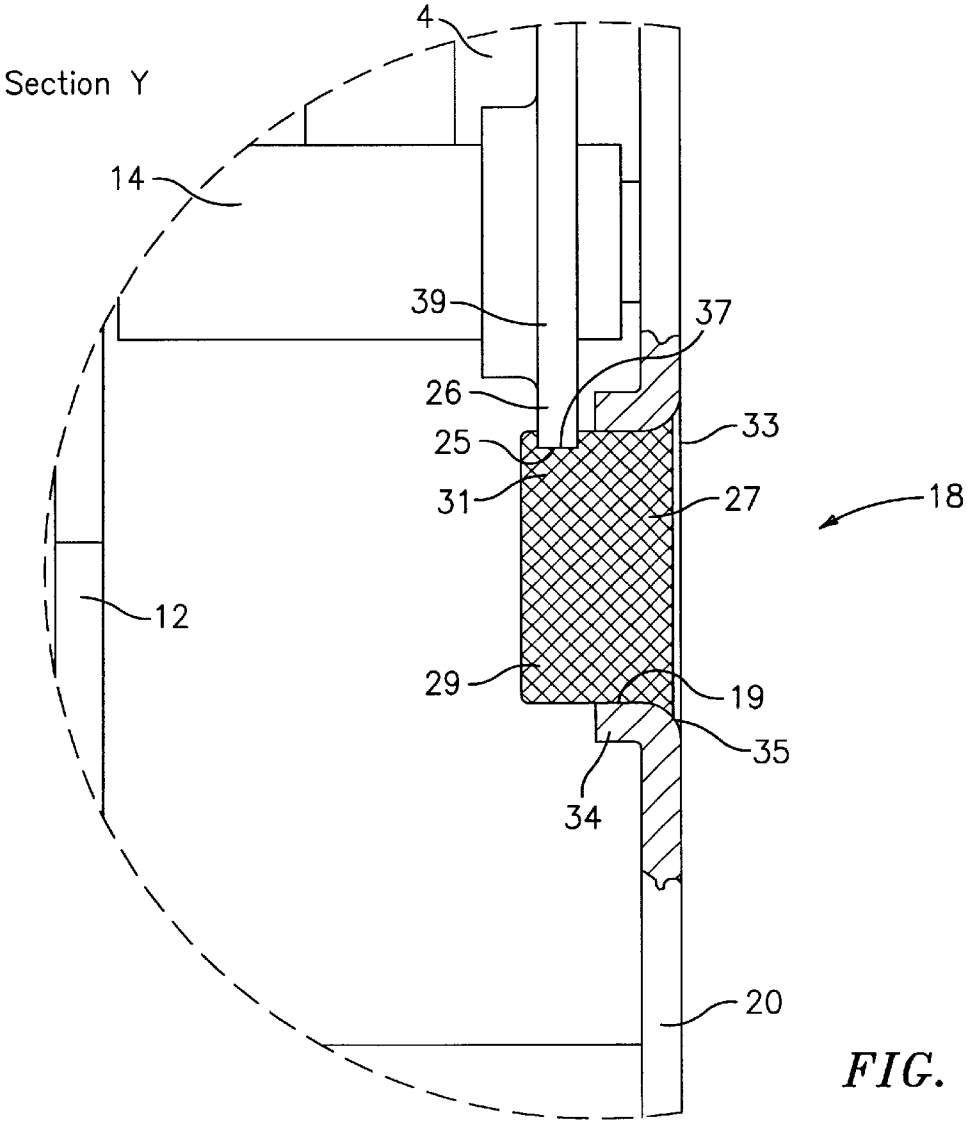
FIG. 5 shows the section Y of FIG. 4 in an enlarged view.
Figure 4:
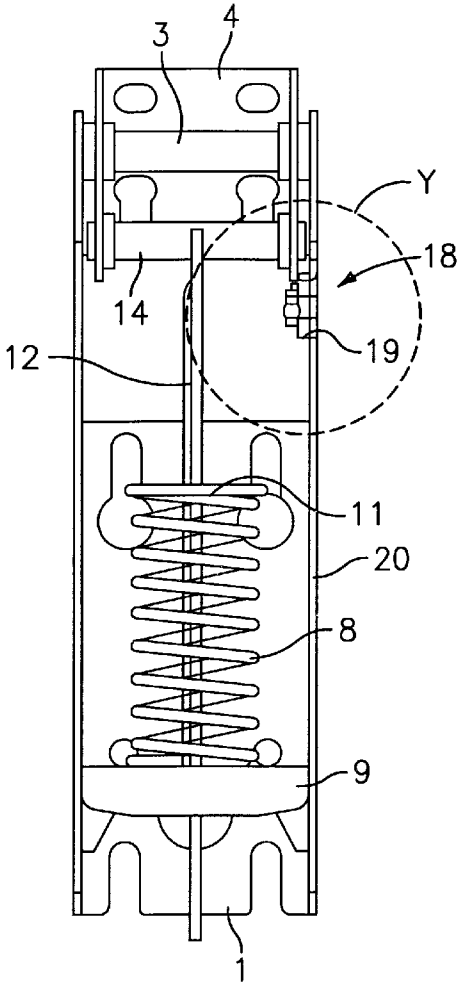
FIG. 4 A shows a modification of the hinge of FIGS. 1 to 3 in which the retaining part is located in the opposite wall of the casing portion in a view from the rear.
Figure 7:
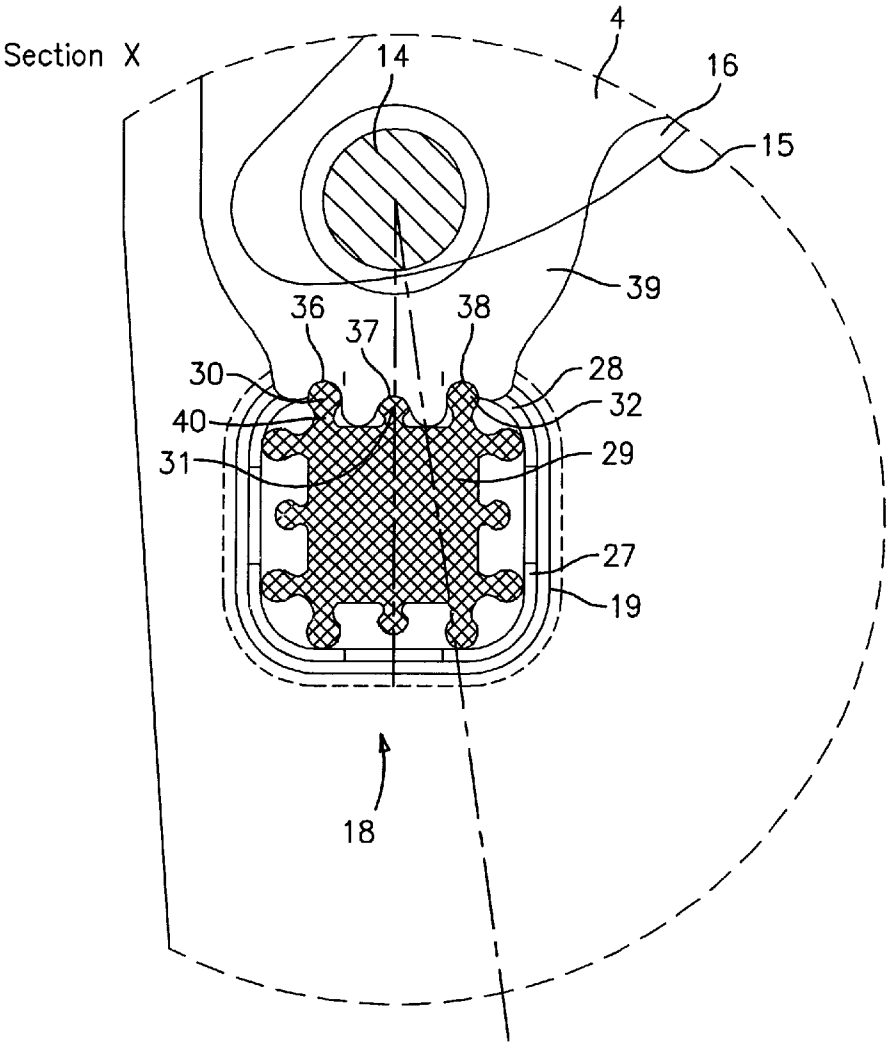
FIG. 7 shows the section X of FIG. 6 in an enlarged view.
Figure 6:
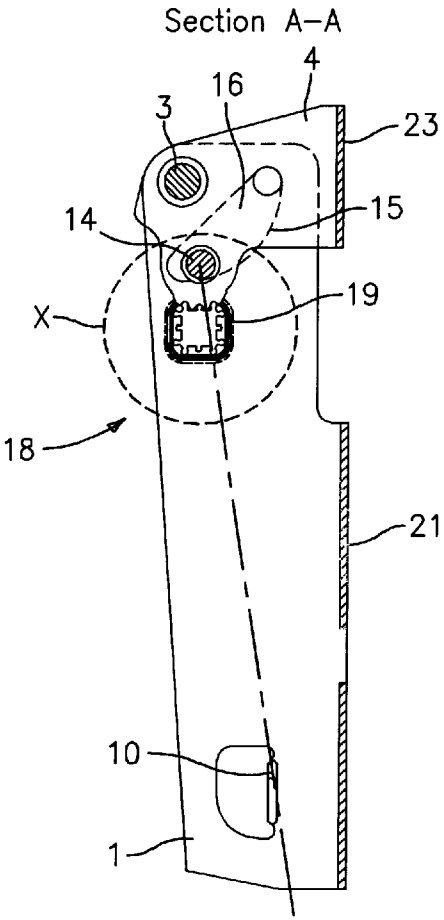
FIG. 6 shows the hinge of FIGS. 1 to 3 in a side view from FIG. 1 at a reduced scale.

The retaining part 18 is shown at an enlarged scale in FIGS. 5 and 7. It consists of an insert part 27 which possesses an essentially square shape with rounded corners 28 and a serration part 29 which is also essentially square, with on each side of the square three teeth each being provided of which in the presentation of FIG. 7 only those teeth 30, 31, 32 engaging a corresponding counter-serration are provided with reference symbols.

The insert part 27 is inserted in the punched-out opening 19 in the side wall 20 of the casing portion 1. It can be seen from FIG. 5 that the insert part 27 and thus the retaining part 18 does not protrude, that it therefore does not extend over the side wall 20 or its outer surface. The outer end surface 33 of the insert part 27 of the retaining part 18 has a flush close to the outer plane of the side wall 20. The punched-out opening 19 in the side wall 20 possesses an inward flute 34 visible in FIG. 5 through which an inner contact surface for the insert part 27 is formed. The side wall 20 moves into the flute 34 through a rounding 35. The insert part 27 abuts this rounding in the manner visible from FIG. 5.

The teeth 30, 31, 32 engage recesses 36, 37, 38 provided in an extension 39 of the lid portion 4 which are in turn disposed between teeth neighbouring each other in each case. These teeth of the lid portion 4 engage corresponding gaps between the teeth 30 to 32 of the serration part 29. The teeth 30, 31, 32 each possess a shaft 40 by means of which the head of the relevant tooth is connected to the essentially square part of the serration part 29. The head of the teeth is formed essentially in a semi-circular shape in cross-section at its outer side. It contacts the bottom of the associated recess in the lid portion 4. The thickness of the shaft 40 of the teeth 30 to 32 is sized in such a way that these shafts 40 can reliably accept and withstand the forces caused by the compression spring 8, but that they are destroyed, that is broken off, when the lid 7 is moved after the successful assembly of the hinge. By the teeth engaging the counter-serration, the relative position of the hinge portions (casing portion 1 and lid portion 4) to each other is accordingly reliably fixed in place during the assembly of the hinge. After assembly, the teeth 30 to 32 can be broken off by a movement of the lid 7.

The teeth 30 to 32 are formed as small. They are so small that they cannot impair the mechanism of the hinge as broken-off teeth.

As can be seen from FIG. 7, there is provided on each of the four sides of the square serration part 29 a serration which consists of three teeth in each case. In this way, the retaining part 18 can be used repeatedly, which is of particular advantage for the assembly of a spare part. The retaining part can be snapped out of place in this case prior to the dismantling of the hinge. It can then be snapped into place again with undamaged teeth when turned through 90° (or through 180° or 270°) so that it can be used for another assembly.

By means of the invention, a hinge retainer is provided which does not have to be removed in an additional procedure after the assembly of the hinge. As the hinge retainer does not extend over the side, the packing of the hinge is not hindered; the hinges can be placed and packed abuttingly next to each other. The retaining part can be made of plastic. It can be snapped into a rectangular punched-out opening of the hinge casing and engage a corresponding counter-serration on the movable hinge portion with its serration. By means of the hinge retainer, the hinge can be retained in a perfect neutral position, irrespective of whether the spring force produces an opening or closing moment or not. After the assembly of the hinge, the retainer does not need to be removed as the serration of the plastic part is just strong enough that it retains securely, but breaks at the first opening of the hinge. As no bias is required for the hinge retaining, it can also be used with a hinge without a spring. Such a hinge without a spring can be blocked in the neutral position and manufactured and supplied in this shape.

The teeth of the serration are advantageously designed in a way which produces only tiny broken-off pieces, to the extent that they break at all and do not just bend down, so that these pieces cannot lead to a hindrance of the mechanism.

The hinge retainer is designed so that it does not protrude at the hinge side so that the packing of the hinges can be performed without hindrance and so that the plastic covering parts of the hinge can also be fitted without removing the hinge retainer. The accessibility of the screws is also ensured without hindrance.

The hinge retainer in accordance with the invention makes the hinge or its assembly on a piece of furniture or an appliance, in particular a freezer, automatable for the user. The hinge retainer can be realised as an extremely cheap part which can be manufactured with a low material requirement from low-quality plastic and which can be installed with automation capability. The hinge retainer is furthermore easy to dismantle at any time to separate waste metal/plastic. It is easy to assemble manually. The retaining part or the hinge retainer can be used as a carrier of a suitable writing or to distinguish hinge types by a striking colour.

What is claimed is:

1. A hinge with a casing portion (1) and a lid portion (4) which is movably supported on the casing portion (1), wherein a retaining part (18) is provided on the casing portion (1) or the lid portion (4) by means of which the relative position of both parts (1,4) is fixed in place, the retaining part (18) possesses a serration (30, 31, 32), and the serration (30–32) is provided on several sides of the retaining part (18).

2. A hinge in accordance with claim 1, wherein the serration (30–32) is provided on several sides of a polygon.

3. A hinge in accordance with claim 1, wherein the serration (30–32) is provided on all sides of the retaining part (18).

4. A hinge in accordance with claim 2, wherein the serration (30–32) is provided on all sides of the polygon.

5. A hinge with a casing portion (1) and lid portion (4) which is movably supported on the casing portion (1), wherein a retaining part (18) is provided on the casing portion (1) or the lid portion (4) by means of which the relative position of both parts (1, 4) is fixed in place, and at least one part of the retaining part (18) fixing the hinge in place is a destructible part, said destructible part constituted by at least one tooth.

6. A hinge in accordance with claim 5, wherein said at least one part of the retaining part (18) fixing the hinge in place is bendable.

7. A hinge in accordance with claim 5, wherein said at least one part of the retaining part (18) fixing the hinge in place is breakable.

8. A hinge in accordance with claim 5, comprising a plurality of parts of the retaining part (18) fixing the hinge in place.

9. A hinge in accordance with claim 8, wherein the fixing parts are constituted by teeth (30–32) being destructible.

10. A hinge in accordance with claim 9, wherein said teeth (30–32) are bendable.

11. A hinge in accordance with claim 9, wherein said teeth (30–32) are breakable.

12. A hinge in accordance with claim 5, wherein the at least one destructible part of said retaining part (18) is small.

13. A hinge in accordance with claim 5, wherein the retaining part (18) is provided on the casing portion (1).

14. A hinge in accordance with claim 5, wherein a tension spring (8) is provided on one of the two portions (1, 4).

15. A hinge in accordance with claim 14, wherein the tension spring (8) is provided on the casing portion (1).

16. A hinge in accordance with claim 1, wherein the retaining part (18) is made of plastic.

17. A hinge in accordance with claim 1, wherein the retaining part (18) is inserted into an aperture in the casing portion (1) or the lid portion (4).

18. A hinge in accordance with claim 17, wherein the aperture is a punched-out opening (19).

19. A hinge in accordance with claim 5, wherein the retaining part (18) does not protrude.

20. A hinge in accordance with claim 17, wherein the aperture possesses the shape of a polygon.

21. A hinge in accordance with claim 20, wherein the aperture possesses the shape of a regular polygon.

22. A hinge in accordance with claim 20, wherein the aperture, possesses the shape of a rectangle.

23. A hinge in accordance with claim 21, wherein the aperture possesses the shape of a square.

24. A hinge in accordance with claim 18, wherein the punched-out opening (19) possesses the shape of a polygon.

25. A hinge in accordance with claim 24, wherein the punched-out opening (19) possesses the shape of a regular polygon.

26. A hinge in accordance with claim 24, wherein the punched-out opening (19) possesses the shape of a rectangle.

27. A hinge in accordance with claim 25, wherein the punched-out opening (19) possesses the shape of a square.

28. A hinge in accordance with claim 5, wherein the retaining part can be or is marked or written on.

29. A hinge in accordance with claim 5, wherein the lid portion (4) is pivoted (3) on the casing portion (1).

* * * * *